US005239523A

United States Patent [19]

Chin-Hsing

[11] Patent Number: 5,239,523

[45] Date of Patent: Aug. 24, 1993

[54] VOCAL REPORTING DEVICE FOR POINTER TYPE TIMERS WITH ACCUMULATIVE TIMING TRANSFORMATION

[75] Inventor: Feng Chin-Hsing, Tao-Yuan Hsien, Taiwan

[73] Assignees: Tai-Chia Feng; Jung-Fu Pan, both of Taiwan

[21] Appl. No.: 834,375

[22] Filed: Feb. 12, 1992

[51] Int. Cl.[5] ..... G04B 21/08; G04B 21/00

[52] U.S. Cl. ..... 368/63; 368/272

[58] Field of Search ..... 368/21-27, 368/28-40, 63, 272-274

[56] References Cited

U.S. PATENT DOCUMENTS 1,889,108 11/1932 Rattig ..... 368/63

3,135,084 6/1964 Kidder ..... 368/63

4,396,297 8/1983 Akahane ..... 368/272

4,531,841 1/1989 Thompson et al. ..... 368/36

4,712,926 12/1987 Tanabe ..... 368/36

*Primary Examiner*—Bernard Roskoski

*Attorney, Agent, or Firm*—Bacon & Thomas

[57] ABSTRACT

A vocal reporting device for pointer type timers includes an encoding board on which three separate encoding circuits are printed, respectively representing an hour signal, a higher order digit minute signal and a lower order digit minute signal. Three signal pick up devices are synchronously rotatable with the pointer shafts of the timer to sweep through the respective encoding circuit and pick up hour and minute signals. These signals are then processed by a central processing unit and a vocal processing unit and broadcast in a synthetic voice via a speaker.

4 Claims, 3 Drawing Sheets

VOCAL REPORTING DEVICE FOR POINTER TYPE TIMERS WITH ACCUMULATIVE TIMING TRANSFORMATION

FIELD OF THE INVENTION

The invention relates generally to a time reporting system and in particular to a vocal reporting device for pointer type timers.

BACKGROUND OF THE INVENTION

It is easy to achieve vocal reporting of time in digital display type timers or electronic timers by processing and controlling the digital signals thereof. However, it is not so easy to have the same achievement in a pointer type timer, integrating the pointer type timer, which generally generates mechanical signal, with a vocal reporting system, which principally makes use of digital electronic signals to generate synthetic vocal signals, is a tough task. It is therefore desirable to have a device to convert the mechanical signals, which relate to the positions of the pointers, into corresponding digital electronic signals, and thus providing a pointer type timer with a vocal reporting system.

OBJECTS OF THE INVENTION

It is an object of the present invention to provide a vocal time reporting device to be incorporated in a pointer type timer to read and convert a mechanical time signal (i.e. positions of the pointers) of the pointer type timer into a commensurate electronic digital time signal which is in turn used in a voice synthesis device to produce the desired vocal report of time.

It is another object of the present invention to provide a simple device to read the hour, minute and second signals of a pointer type timer and to process and transmit these signals to a central processing unit to synchronize the digital time signal of the central processing unit with the mechanical time signal of the pointer type timer and then broadcast the time indicated by the timer at any desired instance via a vocal processing unit.

To achieve the above-mentioned objects, there is provided a vocal reporting device for pointer type timers comprising an encoding board on which three separate encoding circuits are printed, respectively representing an hour signal, a higher order digit minute signal and a lower order digit minute signal. Three signal pick up devices are synchronously rotatable with the pointer shafts of the timer to sweep through the respective encoding circuit and pick up hour and minute signals. These signals are then processed by a central processing unit and a vocal processing unit and broadcast in a synthetic voice via a speaker.

Other objects and advantages of the invention will be apparent from the following description of the preferred embodiments taken in connection with the accompanying drawings wherein:

DETAILED DESCRIPTION OF THE PREFERRED EMBODIMENTS

Figure 1:
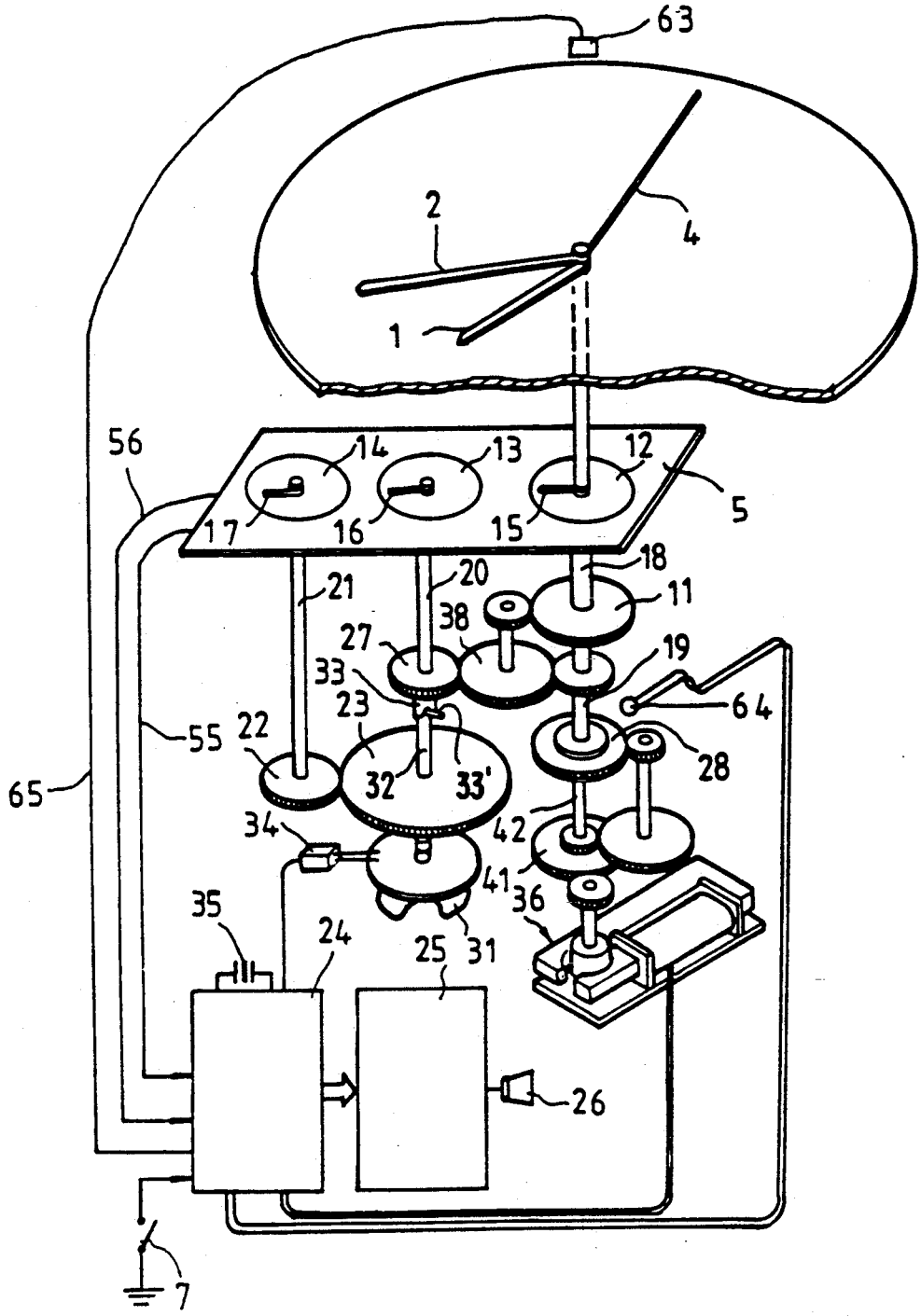
FIG. 1 is a perspective view of a vocal reporting device of the present invention incorporated in a pointer type timer showing the mechanical portion thereof and schematically showing the electronic portion thereof.
Figure 2:
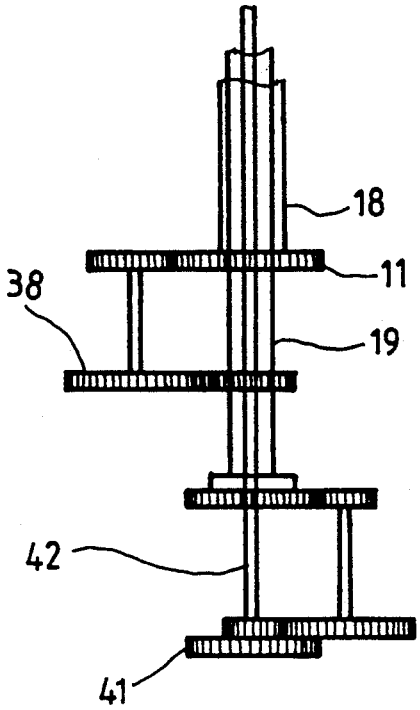
FIG. 2 is a partial cross-sectional view showing in detail the structure of the hour pointer driving shaft, minute pointer driving shaft and the second pointer driving shaft.

With reference to the drawings and in particular to FIGS. 1 and 2, a pointer type timer comprises generally an hour pointer 1, a minute pointer 2, and a second pointer 4 respectively driven by an hour gear 11, a minute gear 28 and a second gear 41 via an hour driving shaft 18, a minute driving shaft 19 and a second driving shaft 42. All of the driving shafts 18, 19 and 42 may be arranged coaxially. A stepping motor 36 is used to actuate the second gear 41 via a gear train. The hour gear 11 and the minute gear 28 can thus be driven by means of gear trains of appropriate gear ratios. The structure of the timer described in this paragraph is well known to those skilled in the timer art.

According to an aspect of the present invention, there is provided an encoding board 5, on which three separate circular encoding circuits are printed, respectively, representing an hour signal 12, a higher order digit minute signal 13 and a lower order digit minute signal 14. The encoding circuits 12, 13 and 14 are better seen in FIG. 3. The hour signal encoding circuit 12 is associated with an hour signal pick up device 15 which rotates coaxially and synchronously with the hour driving shaft 18 to sweep through the hour encoding circuit and thus pick up signals therefrom. Similarly, the higher digit minute signal encoding circuit 13 is associated with a higher digit minute signal pick up device 16 to pick up signals therefrom and the lower digit minute signal encoding circuit 14 is associated with a lower digit minute signal pick up device 17 to pick up signals therefrom. The signals so picked up are then transmitted to a central processing unit 24 and used to generate a synthetic voice in a vocal processing unit 25 and broadcast via a speaker whenever a switch 7 is triggered.

A clock signal generator 35 (namely an oscillating quartz) supplies a series of pulses to the central processing unit 24 to serve as the clock base thereof. The central processing unit 25 generate therein the second, minute and hour signals with the pulses generated by the oscillating quartz 35. In addition, the series pulses are also supplied to control the stepping motor 36 which provides rotation to the pointers 1, 2 and 4 of the timer. In this way, the positions of the pointers 1, 2 and 4 are synchronous with the electronic digital time signal in the central processing unit 24. The accuracy of the time can be further improved with a calibration procedure, as will be described in detail hereinafter.

In the embodiment shown in FIG. 1, a higher digit minute signal driving shaft 20, which drives the higher digit minute signal pick up device 16 to sweep through the higher digit minute signal encoding circuit 13, is driven by the minute driving shaft 19 via a gear 27. The lower digit minute signal driving shaft 21, which drives the lower digit minute signal pick up device 17, is in turn driven by the higher digit minute driving shaft 20 via gears 22 and 23. However, in order to reduce wear and abrasion between the higher and lower digit minute signal encoding circuits 13, 14 and the higher and lower minute signal picking up devices 16, 17, the gear 27 is not brought into engagement with the minute driving shaft 19 unless a manual adjustment of the pointers 1, 2 and 4 is to be conducted. Therefore, the central processing unit 24 receives only the hour signal from the hour signal pick up device 15 in a normal operation situation.

In order to manually adjust the pointers 1, 2 and 4 of the timer, an adjusting button 31 is first depressed to enable a rod 32 which is secured thereon to rotate the higher digit minute signal driving shaft 20 via with a projection 33', which is attached on the rod 32, and inserted into a recessed member 33 attached to the gear 27 and thus to the higher digit minute signal driving shaft 20. The lower digit minute signal driving shaft 21 is also driven through the gears 22 and 23. The rotation of the gear 27 is transmitted to the hour driving shaft 18 and the minute driving shaft 19 via a gear 38. In this way, positions of the pointers 1, 2 and 4 and thus the time associated therewith can be adjusted manually. During manual adjustment of the time, the depression of the button 31 triggers an adjusting switch 34 which in turn informs the central processing unit 24 of the adjustment to be carried out. Each time the adjusting button 31 is rotated a full circle, the lower digit minute signal encoding circuit 14 sends out a plurality of pulses, for example ten in this embodiment, to the lower digit minute signal pick up device 17, because to the same number of equally spaced conductors are disposed on the lower digit minute signal encoding circuit 14. The pulses are then transmitted to the central processing unit 24 to notify the latter of the positions of the pointers, which are mechanically and synchronously associated with the signal picking up devices 15, 16 and 17 through gear trains, and thus the newly-adjusted time. Each of the pulses generally represents a time period of the same length, for example one minute in this embodiment. During the adjustment, the central processing unit 24 monitors and records the number of turns of each of the signal picking up devices 15, 16 and 17 relative to the respective encoding circuits 12, 13 and 14. By accumulating the pulses and counting the number thereof, the time currently indicated by the pointers 1, 2 and 4 can be derived by the central processing unit 24 with a pre-implemented algorithm which is apparent to those skilled in the art and thus no detail concerning it shall be given hereinafter.

Figure 3:
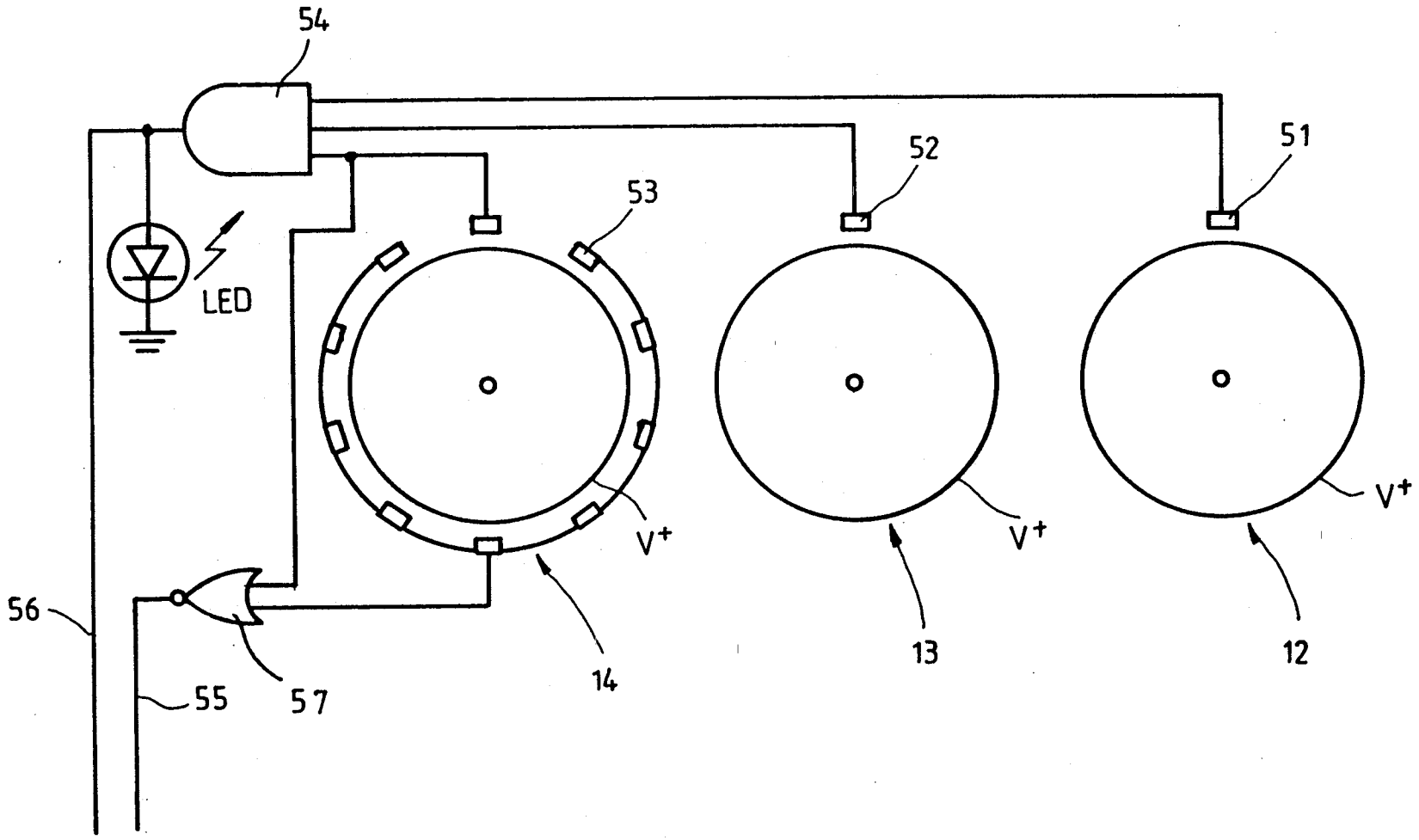
FIG. 3 is a top view of an encoding disk incorporated in the device shown in FIG. 1.

FIG. 3 shows the detail of the encoding circuits 12, 13 and 14 printed in the encoding board 5. The hour signal encoding circuit 12, which is shown to the right of FIG. 3, comprises a first ring-like conductor of a voltage V+ and a calibration conductor 51 which are so disposed with respect to each other that when the hour signal pick up device 15, which has a circular trace concentric with the first ring-like conductor, completes a full turn and passes the first calibration conductor 51, which has a limited width in the direction of the trace of the hour signal pick up device 15, a pulse will be generated and sent out by the first calibration conductor 51 due to the voltage V+ of the first ring-like conductor and the conductivity therebetween provided by the hour signal picking up device 15. In this way, when the hour pointer 1 makes a full turn by the hour driving shaft 18, for example, when 12 hours have passed, the hour signal picking up device 15 passes the first calibration conductor 51 and generates a calibration pulse which is input to an AND gate 54. It is possible to use more than one first calibration conductors 51 disposed around the first ring-like conductor, for example twelve first calibration conductors 51 each respectively corresponding to an hour so that a calibration pulse is sent to the AND gate 54 every hour.

The higher digit minute signal encoding circuit 13 has a similar construction, namely comprising a second ring-like conductor also of a voltage V+ and a second calibration conductor 52. Similarly to the hour signal encoding circuit, when the higher digit minute signal picking up device 16, which has a circular trace concentric with the ring, completes a full circle, a calibration pulse is generated and transmitted to the AND gate 54. The rotation speed of the higher digit minute signal picking up device 16 is so designed that it makes a full turn within a given period of time, for example every sixty minutes in this embodiment.

The lower digit minute signal encoding circuit 14 also comprises a third ring-like conductor of a voltage V+. The lower digit minute signal encoding circuit 14 further comprises a plurality of equally-spaced third calibration conductors 53, such as ten in this embodiment, concentrically disposed around the third ring-like conductor so that when the lower digit minute signal pick up device 17, which has a circular trace concentric with the third ring-like conductor, passes through one of the third calibration conductors 53 after each pre-defined period of time determined by the angular speed of the lower digit minute signal picking up device 17 relative to the lower digit minute signal encoding circuit 14 and the number of the third calibration conductors 53, for example one minute in this embodiment, a calibration pulse is generated. The third calibration conductors 53 are electrically connected together and connected to the central processing unit 24 via an electric line 55 and a NOR gate 57 except that one of the conductors 53 is isolated from the others and individually connected to both the AND gate 54 and the NOR gate 57 in order to generate a calibration during the last one of the predefined periods of time, for example the tenth minute in this embodiment. The calibration pulse, instead of being sent to the central processing unit 24, is transmitted to the AND gate 54 via the isolated calibration conductor 53. In this way, the AND gate 54 will be in the ON sate only at an instance determined by the angular speeds of the signal picking up devices 15, 16 and 17, for example, in this embodiment, every twelve hours, such as at zero o'clock and twelve o'clock, at which time a high voltage will be present at the out-port thereof and a first light emitting diode (LED) indicator which is in electrical connection with the out-port of the first light emitting diode will thus be lit. The high voltage output of the AND gate 54 is also used as a reset signal to the central processing unit 24 for serving as a mutual calibration at for example zero or twelve o'clock. In this way, the central processing unit 24 and the pointers 1, 2 and 4 can maintain synchronous time.

Figure 4:
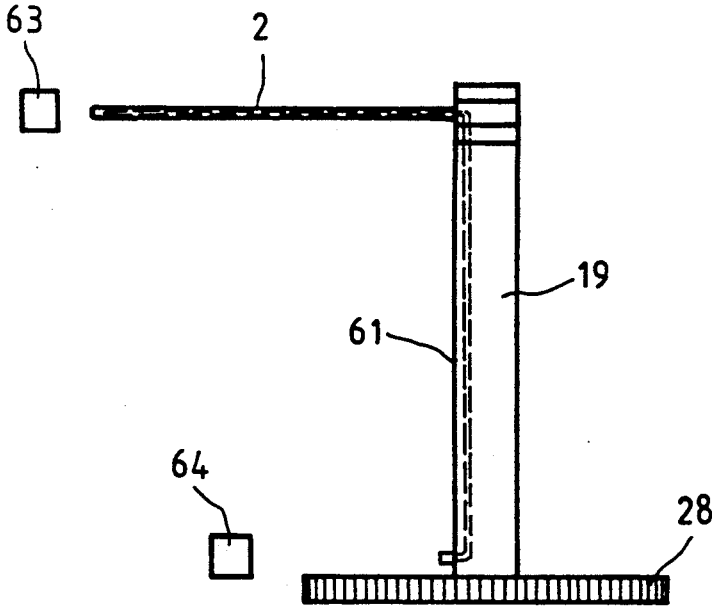
FIG. 4 is a perspective view showing the calibration mechanism with an optical fiber.

Furthermore, the present invention provides a second light emitting diode 63, which is controlled by the central processing unit 24. The second light emitting diode 63 is disposed at a position corresponding to the twelve o'clock position of the timer. A photo-diode 64 is provided to receive the light emitted from the second light emitting diode 63 and then transmit a signal to the central processing unit 24. Also with reference to FIG. 4, an optic fiber 61 is disposed inside the coaxial driving shafts 18, 19 and 42 and extending into one of the pointers, for example the minute pointer 2 in this embodiment, so that when the pointer with the optic fiber 61 therein passes through the second light emitting diode 63, the light emitted from the light emitting diode 63 will be transmitted to the photo-diode 64 via the optic fiber 61 to indicate reaching the twelve o'clock position. To reduce the energy consumption of the second light emitting diode 63, the second light emitting diode 63 may be lit, under the control of the central processing unit 24, only a short period, for example twenty seconds, before the pointer with the optic fiber therein (the minute pointer 2 of this embodiment) reaches the position of twelve o'clock of the timer, and is then turned off after the central processing unit 24 receives a signal from the photo-diode 64.

It is known to those skilled in the art that a third light emitting diode which flashes every second can be used to replace the second pointer 4 of the timer.

It is also conventional to provide a housing (not shown) to have the above-described members or elements disposed therein and a marked surface to indicate the time when the pointers are in corresponding positions.

In the above-described embodiments, the encoding circuits are fixed while the signal pick up devices are rotatable with respect thereto. It is also possible to have the signal pick up devices fixed and the encoding circuits which may be respectively printed in three separate disk-like board or disks, rotatable with respect thereto. The encoding circuits or disks can also be attached to gears which are rotatably secured on the pointer shafts.

It is apparent that although the invention has been described in connection with the preferred embodiments, it is contemplated that those skilled in the art may make changes to certain features of the preferred embodiments without altering the overall basic function and concept of the invention and without departing from the spirit and scope of the invention as defined in the appended claims.

What is claimed is:

1. In a pointer type timer, including at least one pointer for indicating a time and means including at least one driving shaft for moving the pointer, the improvement comprising:

a vocal reporting device including a central processing unit and a vocal processing unit encoding board, said encoding board having printed thereon encoding circuit means having a calibration conductor disposed there around:

means including a signal pickup rotatable with said shaft for forming a circular trace so that each time the pickup passes one of the calibration conductors, a calibration signal is generated and transmitted to the central processing unit; a speaker; and means in said vocal reporting device including a switch which when triggered in response to said calibration signal actuates the vocal processing unit to broadcast the time indicated by the pointer via the speaker, wherein said pointer type timer includes an hour gear, a minute gear, and a second gear driven by an actuating means, said at least one pointer including an hour pointer, a minute pointer, and a second pointer respectively associated with one of a plurality of said driving shafts, said driving shafts including an hour driving shaft, a minute driving shaft, and a second driving shaft, said driving shafts being co-axially arranged and respectively driven by the hour gear, the minute gear, and the second gear, and wherein said encoding circuit means including an hour encoding circuit, a higher order digit minute signal encoding circuit, and a lower order digit minute signal encoding circuit, sand hour encoding circuit including at least one first calibration conductor disposed there around in the vicinity thereof and arranged to send out a first calibration signal to said signal pickup such that said calibration signal is generated and transmitted to an AND gate, said higher order digit minute signal encoding circuit including a second calibration conductor arranged to send out a second calibration conductor arranged to send out a second calibration signal when a second signal pickup is associated therewith, said second signal pickup being rotatable to form a circular trace completing a full circuit, said second calibration signal being transmitted to the AND gate, said encoding board further comprising a lower order digit minute signal encoding circuit having a plurality of equally spaced third calibration conductors which are electrically connected together and in communication with the central processing unit via a NOR gate, except for one electrically isolated calibration conductor which is individually connected to the AND gate and to the NOR gate, each space between two adjacent third calibration conductors representing a unit of time so that when a third signal pickup which is associated with the lower order digit minute signal encoding circuit and is rotatable to form a circular trace which when the third signal pickup moves from one of third calibration conductors to a third calibration conductors, a pulse signal is sent out to the central processing unit for calibration of the positions of the pointers with the central processing unit and, when the third signal pickup means moves to the isolated third calibration conductor, a third calibration signal is sent to the AND gate, said AND gate generating a high voltage output with the first, second and third calibration signals and sending the high voltage output as a reset signal to the central processing unit to synchronize the central processing unit with the positions of the pointers.

2. A device as claimed in claim 1, further comprising a second calibration means including an optical fiber disposed inside the co-axially arranged driving shafts and extending into one of the hour, minute, and second pointers, a light emitting diode which sends out light to an end of the optic fiber inside said pointer and a photo-diode which receives the light transmitted by the optical fiber and sends out a signal to the central processing unit to indicate receipt of the light signal, said light emitting diode being disposed at a predetermined position of the timer so that when one of the pointers passes the light emitting diode, said signal is transmitted to the central processing unit for calibration.

3. A device as claimed in claim 2, wherein said one of the hour, minute and second pointers into which the optical fiber extends is the minute pointer and each time said photo-diode receives a light signal indicates that an hour has passed so that the central processing unit can be calibrated at every hour.

4. A device as claimed in claim 1, wherein said actuating means is a step motor.

* * * * *